US007833447B2

(12) United States Patent
Dahringer et al.

(10) Patent No.: US 7,833,447 B2
(45) Date of Patent: Nov. 16, 2010

(54) PRODUCTION OF FINE STUFFERBOX-CRIMPED TOWS FROM SYNTHETIC FILAMENTS AND FURTHER PROCESSING THEREOF INTO TEXTILE HYGIENE ARTICLES

(75) Inventors: Jörg Dahringer, Bobingen (DE); Michael Klanert, Schwabmunchen (DE); Bernd A. Blech, Bobingen (DE); Stefan Seibel, Maintal (DE); Hartmut Huth, Florsheim (DE)

(73) Assignee: Trevira GmbH, Frankfurt am Main (DE)

( * ) Notice: Subject to any disclaimer, the term of this patent is extended or adjusted under 35 U.S.C. 154(b) by 444 days.

(21) Appl. No.: 11/811,062

(22) Filed: Jun. 8, 2007

(65) Prior Publication Data

US 2007/0234535 A1 Oct. 11, 2007

Related U.S. Application Data

(63) Continuation of application No. 10/372,880, filed on Feb. 24, 2003, now abandoned.

(30) Foreign Application Priority Data

Feb. 27, 2002 (DE) ..... 10 208 353

(51) Int. Cl.
*D04H 3/00* (2006.01)
*B32B 27/02* (2006.01)
*A61F 13/15* (2006.01)

(52) U.S. Cl. ..... 264/168; 264/210.8; 604/370

(58) Field of Classification Search ..... 264/168, 264/171.1, 210.8, 172.1
See application file for complete search history.

(56) References Cited

U.S. PATENT DOCUMENTS

| | | | | |
|---|---|---|---|---|
| 3,199,281 | A | 8/1965 | Maerov et al. | |
| 3,398,220 | A | 8/1968 | Port et al. | |
| 3,505,155 | A | 4/1970 | Balch et al. | |
| 4,009,513 | A | 3/1977 | Andersen | |
| 4,067,850 | A | 1/1978 | Kohler et al. | |
| 4,403,094 | A | 9/1983 | Sasaki et al. | |
| 4,457,884 | A | 7/1984 | Reinehr et al. | |
| 4,552,603 | A | 11/1985 | Harris, Jr. et al. | |
| 4,622,381 | A | 11/1986 | Suzuki et al. | |
| 4,626,184 | A | 12/1986 | Hammond | |
| 4,756,063 | A | 7/1988 | Vehling et al. | |
| 5,171,235 | A | 12/1992 | Theis et al. | |
| 5,177,840 | A | 1/1993 | Laws et al. | |
| 5,382,153 | A * | 1/1995 | Nettelnstroth | 425/308 |
| 5,887,323 | A | 3/1999 | Beifuss et al. | |
| 6,085,395 | A | 7/2000 | Weiss | |
| 6,103,158 | A | 8/2000 | Schafer et al. | |
| 6,240,609 | B1 * | 6/2001 | Rasnick et al. | 28/258 |

FOREIGN PATENT DOCUMENTS

| | | |
|---|---|---|
| DE | 3440975 | 5/1986 |
| EP | 39832 | 11/1981 |
| EP | 937792 | 8/1999 |
| JP | 52037826 | 3/1977 |

OTHER PUBLICATIONS

Franz Fourné, Synthetische Fasern, *Carl Hanser Verlag München Wien*, Jan. 26, 1996.
Loy-Moy-Poy-Hoy-Foy?, *Chemiefasern*, Jun. 1985.
Search Report in DE 10208353 dated Oct. 8, 2003.
Trevira GMBH, Verfahren zur Herstellung feiner stauchgekräuselter Kabel aus synthetischen Filamenten sowie deren Weiterverarbeitung zu textilen Hygieneartikeln, Feb. 14, 2003.

* cited by examiner

*Primary Examiner*—Matthew J. Daniels
(74) *Attorney, Agent, or Firm*—Marshall, Gerstein & Borun LLP

(57) ABSTRACT

A process is described for producing thin crimped tows from LOY, POY, or FOY filaments in a total linear density from 2 ktex to 9 ktex by filament yarns being withdrawn from creeled bobbins, folded and provided with a processing finish, then drawn or tension-uniformized and thereafter heated and stufferbox crimped. The process can be carried out in-line with numerous further processing operations. The tows are particularly useful for producing textile hygiene articles such as diapers, sanitary napkins, inserts and incontinence guards and the like.

12 Claims, No Drawings

PRODUCTION OF FINE STUFFERBOX-CRIMPED TOWS FROM SYNTHETIC FILAMENTS AND FURTHER PROCESSING THEREOF INTO TEXTILE HYGIENE ARTICLES

CROSS-REFERENCE TO RELATED APPLICATION

This application is a continuation of U.S. application Ser. No. 10/372,880 filed Feb. 24, 2003 which is based on German Patent Application No. 102 08 353.3-26, filed Feb. 27, 2002.

FIELD OF THE INVENTION

This invention relates to a process for producing thin stufferbox crimped tows from low-oriented yarn ("LOY"), partially-oriented yarn ("POY"), or fully-oriented yarn "(FOY") filaments and also their further processing into hygiene articles such as diapers, sanitary napkins, inserts, including slip inserts, incontinence guards and the like.

BACKGROUND OF RELATED TECHNOLOGY

The stufferbox crimping process is predominantly used in the production of staple fibers. The initial step in the production of staple fibers is to produce very thick tows, for example by two or more filament bundles being withdrawn from cans, converged to form a tow and conjointly led to a stufferbox, as described for example in EP 0 139 832 B1. The total linear density of the tows is up to 4,000,000 dtex.

Melt spinning processes, which predominantly supply fibers for such stufferbox crimping processes and operate at spinning speeds of 500 m/min or higher, involve direct drawing to a draw ratio of 4:1 to produce a drawn tow at a speed of at least 2000 m/min. These tows can therefore usually not be fed directly to the further processing stages, which frequently operate at appreciably lower speed; they are therefore interveningly stored in cans for example. Moreover, the linear density of such tows is too high for some further processing purposes, especially for producing textile hygiene products.

The processes discussed above require stufferbox crimpers as described for example in EP 0 139 832 B1 and DE 34 40 975 A1.

Fluid-absorbing hygiene articles usually contain acquisition layers consisting of fibrous non-woven material, for example a carded fiber web. EP 0 937 792 A1 describes a process where this absorbing fibrous layer is formed from a thin tow of continuous filaments.

This European patent application does not mention stufferbox crimping, nor the total linear density of the tows used therein nor any process whereby the filament tow mentioned therein is actually to be produced.

Although there are already a whole series of processes in existence for stufferbox crimping fiber tows there is still a need for improved, more flexible processes which make it simple to conform to the requirements of downstream operations.

DETAILED DESCRIPTION

It is an object of the invention to provide a simple and economical process with which the total linear density of the crimped tow can be specifically adjusted to the particular respective requirements of further processing, which can be adapted to the tow linear densities required immediately in a directly downstream further processing operation, which can be followed by an in-line further processing operation and which leads to tows which are particularly useful for producing textile hygiene articles.

"LOY" refers to low-oriented yarn, "POY" to partially oriented yarn, and "FOY" to fully oriented yarn.

This object is achieved by a process for producing thin crimped tows of LOY, POY, or FOY filaments, which includes a) separately winding the individual LOY, POY, or FOY, filament yarns onto bobbins, b) withdrawing the individual yarns from creeled bobbins, the number of bobbins and the linear density of the individual filaments and yarns corresponding to the total linear density of the thin crimped tow, c) folding the filament yarns, d) providing the folded filament yarns with a processing finish, e) withdrawing the finished folded filament yarns by means of a drawing apparatus which includes two pairs of draw rolls and which effects drawing, afterdrawing and/or tension uniformization through low tension draft and preheating, f) subsequently heating and softening the filament yarns by means of a heating apparatus to prepare for the crimping operation, g) stufferbox crimping the heated filament yarn tow, wherein the total linear density of the stufferbox crimped tow is in the range from 2 ktex to 9 ktex and preferably in the range from 3 ktex to 8 ktex and the stufferbox crimping operation is effected at a speed in the range from 200 m/min to 1000 m/min and preferably at a speed in the range from 300 m/min to 800 m/min.

The stufferbox crimping operation is preferably effected at a speed in the range from 300 m/min to 500 m/min.

Melt-spun polyester filaments are particularly advantageous in the invention.

Also very advantageous in the invention are multicomponent filaments and especially bicomponent filaments.

A particular embodiment of the process according to the invention utilizes two or more filament varieties which have different properties.

The invention further provides for the use of the above-described tow for producing textile hygiene articles, especially in an in-line process. The process according to the invention may be carried out, for example, as follows.

The starting LOY, POY, or FOY filament yarn material may be produced in any suitable manner. A known process is described, for example, in the paper by H. Treptow in Chemiefasern/Textilindustrie, June 1985, pages 411 and 412.

Suitable production processes for these filament yarns are known to those of ordinary skill in the art, and the yarns are also commercially available.

After they have been produced, these filament yarns are each separately wound up on bobbins. The linear density of these filament yarns is advantageously in the range from 30 dtex to 300 dtex. The linear density of the individual filaments is preferably in the range from 1 dtex to 16 dtex and especially in the range from 3 dtex to 10 dtex.

The number of bobbins used depends on the target linear density of the stufferbox crimped tow to be produced. The number of bobbins required is simple to calculate from the linear density of the filament yarn. The calculation must allow for drawing of the yarns, where appropriate.

The filament yarns are then folded and subsequently provided with a processing finish. The finish augments tow coherency (cohesion of the filaments within the tow) and must be selected in accordance with the later use of the tow. For example, the use in the hygiene sector requires specific finishes which have been approved for that purpose. The producer twist or the degree of entanglement of the filament yarns to improve their cohesion must be chosen as low as possible. It is merely necessary to ensure impeccable unwinding of creeled bobbins. After folding, the individual filament yarns should have come together to form a homogeneous tow. An excessive twist level or degree of entangling of the individual filament yarns would not be helpful at this stage.

The folded and finished filament yarns are then fed to a drawing apparatus comprising two pairs of draw rolls, the first pair of draw rolls being operated at temperatures between 30° C. and 70° C. and the second pair of draw rolls at godet temperatures between 100° C. and 190° C. LOY and POY yarns will at this stage undergo drawing in conformity with the desired yarn properties, the draw ratio decreasing with the increasing orientation level of the feed yarns. FOY yarns need not absolutely be drawn, so that the drawing apparatus merely effects a uniformization of the tension state through a low tension draft (preferably between 1% and 2%).

The heating in the drawing apparatus also serves as a preliminary stage to the main heating which subsequently takes place in the heating apparatus. This main heating by low pressure steam at around 100° C. causes the filaments to become soft and flexible for the subsequent crimping operation.

On leaving the heating apparatus, the tow is fed to a stufferbox crimping machine where it is stufferbox crimped. It is advantageous to effect the stufferbox crimping operation at a speed in the range from 300 m/min to 800 m/min. It is preferable to effect the stufferbox crimping operation so as to produce about three to five crimps per cm of filament. Useful filament yarns are particularly polyester filament yarns, especially yarns based on polyethylene terephthalate, polybutylene terephthalate, polytetramethylene terephthalate, and the like.

Also very useful are multicomponent and especially bicomponent filaments. Multicomponent yarns and especially bicomponent yarns can be yarns of the core-sheath type or side-by-side bicomponent fibers.

In a further advantageous embodiment, the filament yarns used comprise filaments having different properties. Preference is given to hybrid filament yarns, i.e. yarns, for example polyester yarns, containing filaments of polyesters having different melting points. But it is also possible to use for example hybrid yarns produced from filaments of different polymers, for example polyethylene filaments and polyester filaments.

On leaving the crimping machine the crimped tow may be laid down on a conveyor belt and laid down in cardboard boxes or bales and stored and subsequently shipped.

Preferably, the crimped tows are led directly especially in-line to a further processing operation. In this operation, the tows are advantageously processed into hygiene articles having a textile structure, such as diapers, sanitary napkins, inserts, incontinence guards, etc.

The production of such hygiene articles is known per se. Reference may be made in this connection to EP 0 937 792 A1, the disclosure of which is incorporated herein by reference.

FIG. 1 serves to illustrate the invention.

In FIG. 1, the process according to the present invention is depicted in schematic form. A creel 1 supports a number of mounted bobbins of wound filament yarns. The filament yarns are withdrawn from the creeled bobbins, folded and provided with a processing finish in an apparatus 2. The apparatus 2 can be a bath through which the folded yarns are pulled, but it is also possible to use a spraybox or appropriate rolls or finish-applying godets.

The finished filament yarn tow is then led to a drawing apparatus which comprises two pairs of draw rolls 3 and 4. In the drawing apparatus, the yarns are drawn, the drawing, which is effected in the case of LOY and POY yarns in particular, being guided by the desired properties such as strength and elongation. In the drawing apparatus, furthermore, a uniformization of the tension may take place through a low tension draft. After drawing or uniformizing the tow, the tow is led through a heating apparatus in which the filaments are heated to the temperature needed for crimping. This heating can be effected for example by steam or else by dry heat.

The tow is then led to a stufferbox crimper in which the tow is stufferbox crimped, advantageously by applying three to five crimps per cm.

The examples which follow illustrate the invention.

EXAMPLES 1 AND 2

POY and FOY polyester filaments were used to produce a fiber tow. The following filaments were used:

282 dtex 48 filament POY 167 dtex 32 filament FOY

POY 304 bobbins were installed on a corresponding number of bobbin rails. The total number of filaments was converged together via an inlet comb and pulled through a processing finish bath (typical fiber finish components, 50° C.) by means of rotating rolls. Between these rolls, whose temperature was 45° C., and further rotating rolls, whose temperature was 210° C., the fiber was drawn to a draw ratio of 2.0. Subsequently, the entire drawn filament tow was led through a steambox, heated with low pressure steam (3 bar), to the stufferbox crimper having a roll width of 15 mm and crimped. The fiber tow thus produced was collected in a plastic container. The processing speed was 120 m/min. The draw ratio setting of 2.0 thus resulted in an exit speed of 240 m/min. The total linear density of the tow produced was 4.3 ktex.

The tow produced was found to have the following textile values:

| | |
|---|---|
| Fineness/dtex: | 3.1 |
| Tenacity/cN/tex: | 50 |
| Elongation at break/%: | 42 |
| Thermal shrinkage (200° C.)/%: | 12 |
| Crimp: number of crimps/cm: | 4 |

FOY

The run with FOY was carried out using adjusted settings compared with POY. The fundamental difference was a smaller number of bobbins (210), an omitted drawing operation and a lower temperature of 112° C. at the second rolls. The processing speed was set to 170 m/min. The tow linear density was 3.5 ktex.

The tow produced was found to have the following textile values:

| | |
|---|---|
| Fineness/dtex: | 5.2 |
| Tenacity/cN/tex: | 44 |
| Elongation at break/%: | 42 |
| Thermal shrinkage (200° C.)/%: | 9 |
| Crimp: number of crimps/cm: | 5 |

It was particularly surprising that the invention makes it possible to produce thin tows which, after stufferbox crimping, can be directly fed to further processing. It is thus possible for the production of textile hygiene articles, such as diapers, sanitary napkins, inserts, incontinence guards, to be integrated in-line directly following the stufferbox crimping operation.

The linear densities required for the further processing operation are simple to produce by the process of the present invention.

The process is very flexible and especially useful for facilities which want to carry out stufferbox crimping and further processing in one facility. The process provides a simple way of producing tows having different linear densities and the total linear densities required for each respective further processing operation.

What is claimed is:

1. A process for producing a textile hygiene article selected from the group consisting of diapers, sanitary napkins, inserts, slip inserts, and incontinence guards from thin crimped tows of melt-spun LOY, POY or FOY polyester filaments having an individual titer of 1 to 16 dtex, produced by a process which comprises the steps of:

a) separately winding individual LOY, POY or FOY polyester filament yarns onto creeled bobbins, b) withdrawing the individual filament yarns from the creeled bobbins, the number of bobbins and the linear density of the individual filaments and yarns corresponding to the total linear density of the thin crimped tow, c) converging the individual filament yarns together to form a homogeneous filament yarn tow, d) providing the filament yarn tow with a processing finish, e) withdrawing the finished filament yarn tow by means of a drawing apparatus which comprises two pairs of draw rolls and which effects drawing, afterdrawing, and/or tension uniformization through low tension draft and preheating, f) subsequently heating the filament yarn tow by means of a heating apparatus, and g) stufferbox crimping the set filament yarn tow, wherein the total linear density of the stufferbox crimped tow is in the range from 2 ktex to 9 ktex and the stufferbox crimping operation is effected at a speed in the range of 200 m/min to 1000 m/min, h) and further processing the tows into said hygiene article.

2. The process of claim 1, wherein the total linear density of the stufferbox-crimped tow is in the range of 3 ktex to 8 ktex.

3. The process of claim 1, wherein the stufferbox crimping operation is effected at a speed in the range of 300 m/min to 800 m/min.

4. The process of claim 1, wherein the stufferbox crimping operation is effected at a speed in the range of 300 m/min to 500 m/min.

5. The process of claim 1, wherein the filaments comprise melt-spun polyester filaments.

6. The process of claim 1, wherein the filaments comprise multicomponent filaments.

7. The process of claim 6, wherein the filaments comprise bicomponent filaments.

8. The process of claim 1, wherein the filaments comprise two or more filament varieties having different properties.

9. The process of claim 1, wherein the crimped tows are processed into a diaper.

10. The process of claim 1, wherein the crimped tows are processed into a sanitary napkin.

11. The process of claim 1, wherein the crimped tows are processed into an absorbent insert.

12. The process of claim 1, wherein the crimped tows are processed into an incontinence guard.

* * * * *